US007610779B2

(12) United States Patent
Yang et al.

(10) Patent No.: US 7,610,779 B2
(45) Date of Patent: Nov. 3, 2009

(54) WASHING MACHINE HAVING DEODORIZING UNIT AND CONTROL METHOD THEREOF

(75) Inventors: Byoung Yull Yang, Ansan-Si (KR); Hyung Gyoon Kim, Suwon-Si (KR); Sang Yeon Pyo, Suwon-Si (KR); Hye Soon Yang, Yongin-Si (KR); Seong Min Oak, Masan (KR); Jae Ryong Park, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 654 days.

(21) Appl. No.: 11/105,400

(22) Filed: Apr. 14, 2005

(65) Prior Publication Data

US 2005/0262883 A1 Dec. 1, 2005

(30) Foreign Application Priority Data

May 27, 2004 (KR) ..... 10-2004-0037908

(51) Int. Cl.
*D06F 33/00* (2006.01)

(52) U.S. Cl. ..... 68/12.02; 68/5 R; 68/12.01

(58) Field of Classification Search ..... 680/12.01, 680/12.02, 5 R
See application file for complete search history.

(56) References Cited

U.S. PATENT DOCUMENTS

| | | | | |
|---|---|---|---|---|
| 3,877,152 A | 4/1975 | Gorman | ..... | 34/43 |
| 5,897,672 A * | 4/1999 | Badami et al. | ..... | 8/159 |
| 6,709,499 B2 | 3/2004 | Moschütz | | |
| 2001/0032353 A1 * | 10/2001 | Contadini et al. | ..... | 4/222 |

FOREIGN PATENT DOCUMENTS

| | | | |
|---|---|---|---|
| CN | 1127314 | A | 7/1996 |
| CN | 1436259 | | 8/2003 |
| DE | 2110063 | | 9/1972 |
| EP | 0509328 | A2 | 10/1992 |
| EP | 1072718 | A1 | 1/2001 |
| JP | 5-180368 | | 7/1993 |
| KR | 10-1998-0034280 | | 8/1988 |
| KR | 10-2000-0045300 | | 8/2000 |
| KR | 20-2003-0019552 | | 6/2003 |
| WO | WO 00/52249 | * | 9/2000 |

OTHER PUBLICATIONS

European Search Report for Application No. 05103476.7; dated Nov. 7, 2006.
English translation of Chinese Patent Office Action issued in corresponding Chinese Patent Application No. 200510067766.2 on May 16, 2008.
European Search Report for corresponding European Patent Application No. 05103476.7 dated May 15, 2009 (in English).

* cited by examiner

*Primary Examiner*—Michael Barr
*Assistant Examiner*—Jason Heckert
(74) *Attorney, Agent, or Firm*—Staas & Halsey LLP

(57) ABSTRACT

A washing machine having a deodorizing unit that performs a deodorizing operation independently of a washing process, to remove odor from an object to be deodorized, and a control method thereof. The control method has operation of determining whether a deodorizing signal is inputted by a user, and performing a deodorizing mode using the deodorizing unit independently of a washing process, if it is determined that the deodorizing signal is inputted.

8 Claims, 13 Drawing Sheets

WASHING MACHINE HAVING DEODORIZING UNIT AND CONTROL METHOD THEREOF

CROSS-REFERENCE TO RELATED APPLICATIONS

This application claims the benefit of Korean Patent Application No. 2004-37908, filed May 27, 2004, in the Korean Intellectual Property Office, the disclosure of which is incorporated herein by reference.

BACKGROUND OF THE INVENTION

1. Field of the Invention

The present invention relates to a washing machine having a deodorizing unit, and a control method thereof, and more particularly, to a washing machine having a deodorizing unit to remove odor from objects to be deodorized, and a control method of the washing machine.

2. Description of the Related Art

Generally, washing machines are apparatuses to remove contaminants from clothes using friction between water and the clothes, and are divided into various types based on washing methods. A drum type washing machine, which has been widely used, and is shown in FIG. 1, comprises a tub 2 having a cylindrical structure installed in a main body 1 to contain wash water, a drum 3 having a cylindrical structure rotatably installed in the tub 2 and provided with a plurality of drain holes through a wall thereof, a driving motor 4 rotating the drum 3 in regular and/or reverse directions, and a door 5 to open and close the main body 1, to put or take laundry into and out of the washing machine.

The conventional drum type washing machine further comprises a water supply unit 6 installed on an upper part of the tub 2 supplying wash water to the tub 2, a drain unit 10 forcibly discharging the wash water from the tub 2, and a drying unit 13 drying the laundry.

The water supply unit 6 includes a water supply valve 7, a water supply pipe 8, and a detergent-dissolving device 9, and the drain unit 10 includes a drain pipe 11 and a drain pump 12. The drying unit 13 includes an air blast fan 14 installed on the upper part of the tub 2, a discharge duct 15 connecting an outlet of the air blast fan 14 and an opening of the tub 2, a condensing duct 16 connecting an air outlet installed through the lower part of the rear portion of the tub 2 and an inlet of the air blast fan 14, and a heater 17 installed in the discharge duct 15.

When washing instructions are inputted to the above conventional drum type washing machine, a microcomputer (not shown) opens the water supply valve 7 so that wash water is supplied to the drum 3, performs washing, rinsing and spin-drying operations, and then dries clothes put in the drum 3 by turning on the heater 17 and the air blast fan 14, so that hot blown air is supplied to the drum 3.

Since the conventional drum type washing machine does not have a deodorizing unit, if particles of offensive odor, such as the smell of tobacco or food, are attached to clothes, the conventional drum type washing machine only performs washing/rinsing/spin-drying/drying operations on the clothes only to remove the odor from the clothes. Accordingly, the conventional drum type washing machine is disadvantageous, in that it increases wear-and-tear of the clothes with the increased washing frequency, and requires unnecessary consumption of electric power.

SUMMARY OF THE INVENTION

Therefore, an aspect of the invention is to provide a washing machine having a deodorizing unit, which removes offensive odor from objects to be deodorized, and a control method thereof.

Another aspect of the present invention is to provide a washing machine having a deodorizing unit, which performs a deodorizing operation independently of a washing process, and a control method thereof.

In accordance with one aspect, the present invention provides a control method of a washing machine having a deodorizing unit comprising the operations of: (a) determining whether a deodorizing signal is inputted by a user; and (b) performing a deodorizing mode using the deodorizing unit independently of a washing process, if it is determined that the deodorizing signal is inputted.

In accordance with a further aspect, the present invention provides a control method of a washing machine having a deodorizing unit comprising: using an odor sensing unit, sensing odor of an object to be deodorized, which has been placed in a drum; and performing a deodorizing mode using the deodorizing unit, if is determined that the odor of the object is sensed by the odor sensing unit.

In accordance with another aspect, the present invention provides a control method of a washing machine having a plurality of deodorizing resources, comprising: determining whether a deodorizing signal is inputted by a user; and performing a deodorizing mode using at least one deodorizing resource selected from the plurality of deodorizing resources, if it is determined that the deodorizing signal is inputted.

In accordance with yet another aspect, the present invention provides a control method of a washing machine having a plurality of deodorizing resources, comprising: using an odor sensing unit, sensing odor of an object to be deodorized, which has been placed in a drum; and performing a deodorizing mode to remove odor from the object using at least one deodorizing resource selected from the plurality of deodorizing resources, if it is determined that odor of the object is sensed by the odor sensing unit.

In accordance with still yet another aspect, the present invention provides a washing machine having deodorizing unit, comprising: a drum rotatably installed in a main body; at least one deodorizing resource installed in the main body; and a control unit performing a deodorizing mode using the deodorizing resource, to remove odor from an object to be deodorized, which has been placed in the drum.

Additional aspects and/or advantages of the invention will be set forth in part in the description which follows, and in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION

Figure 1:
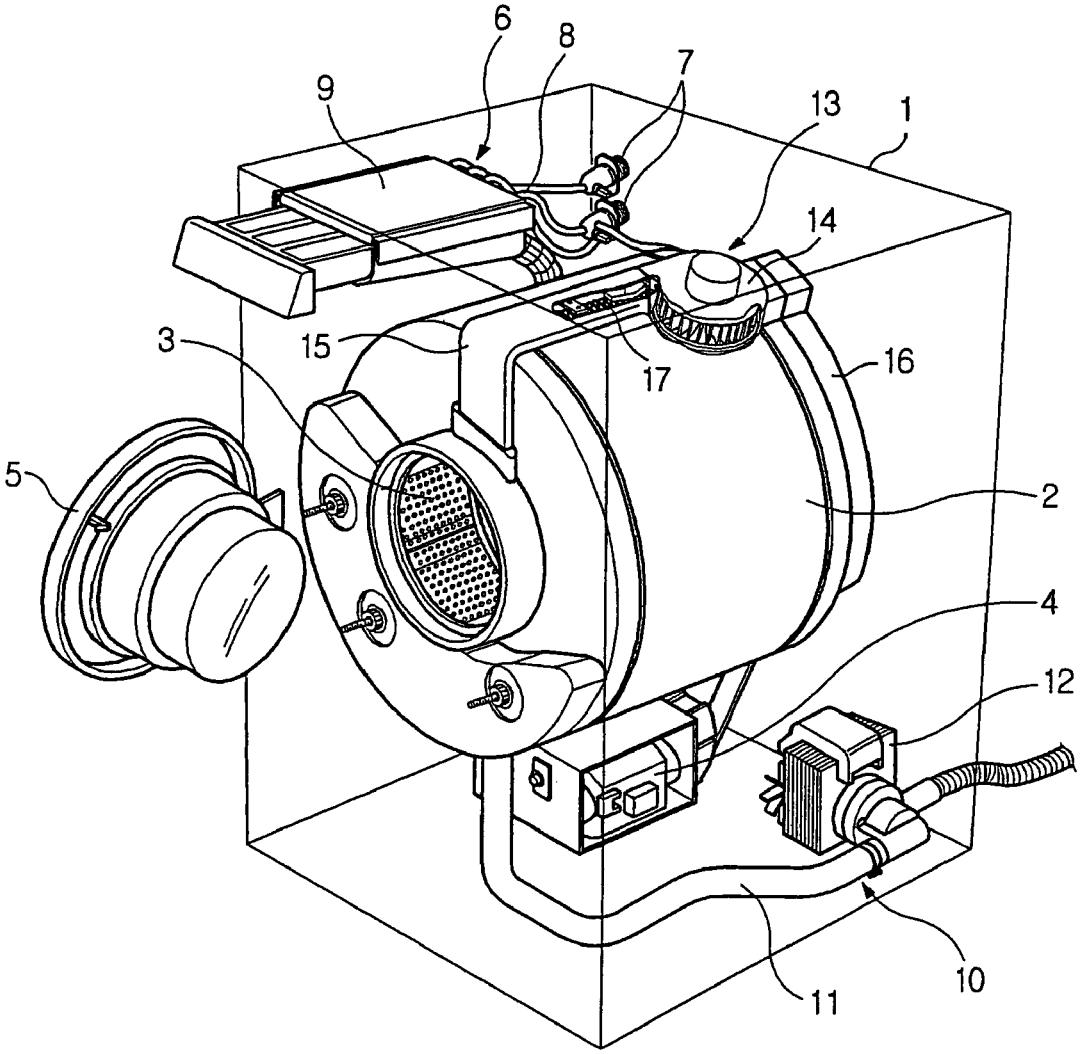
FIG. 1 is a perspective view of a conventional drum type washing machine.

Reference will now be made in detail to embodiments of the present invention, examples of which are illustrated in the accompanying drawings, wherein like reference numerals refer to the like elements throughout. The embodiments are described to explain the present invention by referring to the figures.

Figure 2:
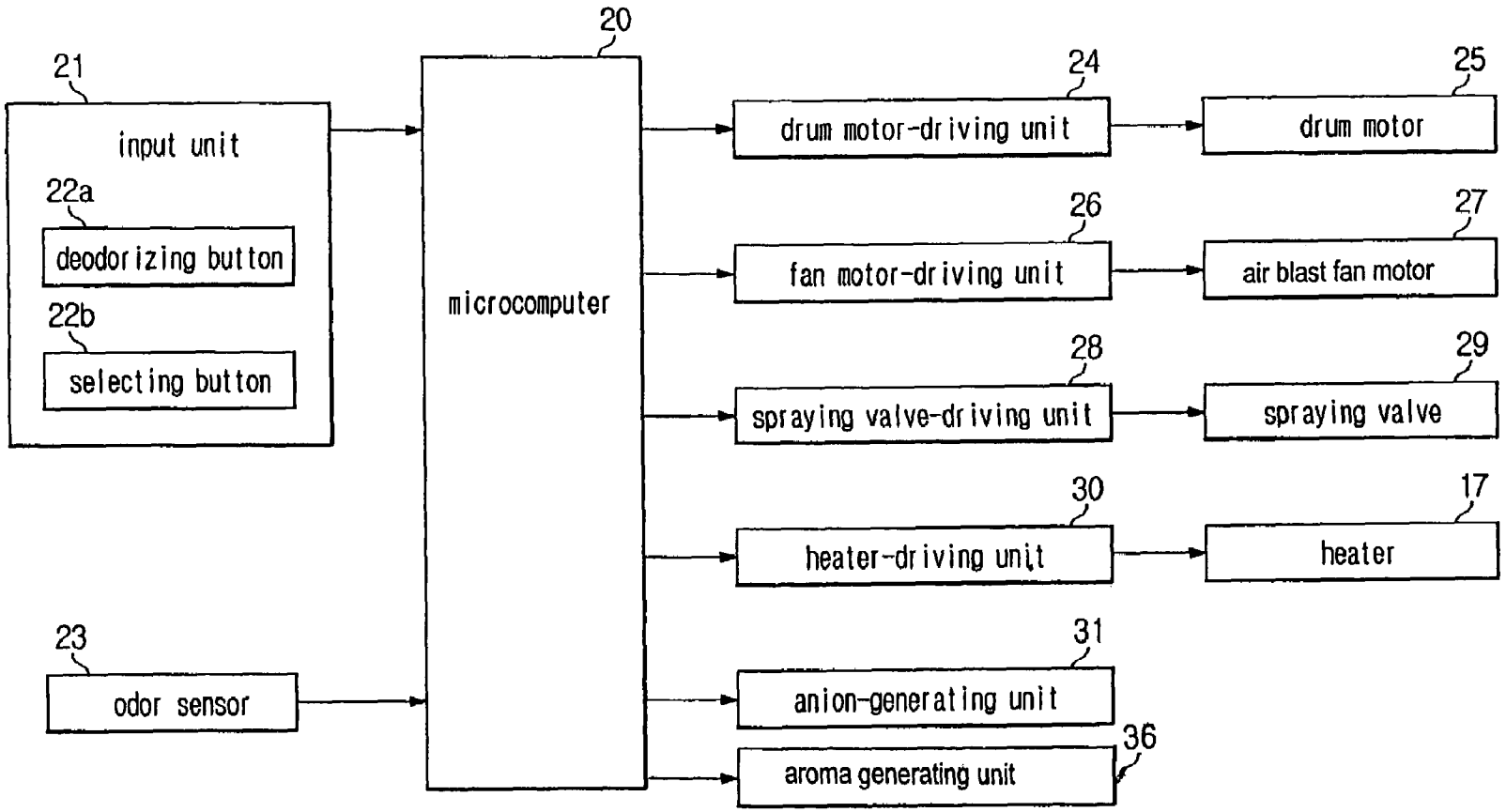
FIG. 2 is a block diagram of a drum type washing machine having a deodorizing unit in accordance with an embodiment of the present invention.

A drum type washing machine in accordance with a first embodiment of the present invention, as shown in FIG. 2, comprises, in addition to the components shown in FIG. 1, a deodorizing unit, namely: an input unit 21 having a plurality of keys, an odor sensor 23 sensing odor of internal air of the tub 2, a drum motor-driving unit 24 driving a drum motor 25 to rotate the drum 3, a fan motor-driving unit 26 driving an air blast fan motor 27 rotating an air blast fan 13 to forcibly blow air to the drum 3, a heater-driving unit 30 driving a heater 17, an anion-generating unit 31 generating anions, an aroma-generating unit 36 generating an aroma, a spraying valve 29 controlling the flow of water supplied to a nozzle (not shown) spraying water in a misty state into the drum 3, a spraying valve-driving unit 28 driving the spraying valve 29, and a microcomputer 20 controlling the above-described components. According to one embodiment, a humidifying device may include the spraying valve 29. According to another embodiment, a hot blown air supplying device may comprise the heater 17 and the air blast fan motor 27.

The input unit 21 is installed on an upper part of a front surface of a main body 1, and includes a deodorizing button 22*a* to input deodorizing instructions therethrough, and a selecting button 22*b* to select a kind of an object to be deodorized.

The odor sensor 23 serves to sense particles of odor separated from clothes put into a drum 3, and employs an electronic nose sensor. The electronic nose sensor is a gas sensor that detects quantifies molecules of gas of odor generated from various environments, and outputs different response signals based on the kinds of the gas, thereby distinguishing odor. The electronic nose sensor may comprise a plurality of sensors.

When the electronic nose sensor is exposed to an odor, the electronic nose sensor generates a specific response signal based on the kind of gas, which is the source of the odor. The electronic nose sensor abstracts characteristics from the generated response signal and classifies the odor according to the characteristics, to determine the kind of the sensed gas. An electronic nose sensor, which is mainly used now, is an array-type sensor obtained by combining a plurality of gas sensors, or is an micro-type sensor having a miniature size (for example, manufactured and sold by Aroma Scan in England or Hewlett-Packard in the U.S.).

When the odor sensor 23 employs the electronic nose sensor, the odor sensor 23 generates different response signals according to the kinds of odor, i.e., the odor of tobacco, food, or etc., of the clothes put into the drum 3, and detects ingredients of the odor permeating the clothes by analyzing the response signals.

The spraying valve 29 is installed in a water supply pipe (not shown) supplying water to the nozzle. The nozzle passes through the upper surface of the tub 2, and a plurality of fine through holes (not shown) are formed through the nozzle such that the through holes face the drum 3 to supply water in a misty state to the drum 3. Accordingly, when water is supplied to the nozzle, the nozzle sprays water in the misty state and supplies the water to the inside of the drum 3 through drain holes formed through the drum 3.

Hereinafter, with reference to FIGS. 3*a* and 3*b*, an operation of the drum type washing machine shown in FIG. 2 will be described. First, with reference to FIG. 3*a*, which illustrates a deodorizing operation performed according to a user's deodorizing instructions, the microcomputer 20 determines whether or not the user's deodorizing instructions are inputted to the washing machine (operation S40). The deodorizing instructions are inputted to the washing machine by pressing the deodorizing button 22 installed on the input unit 21 by a user.

If it is determined that the user's deodorizing instructions have not been inputted to the washing machine, the microcomputer 20 terminates a corresponding cycle, and if it is determined that the user's deodorizing instructions have been inputted to the washing machine, the microcomputer 20 performs a deodorizing mode. The deodorizing mode in this embodiment of the present invention is performed independently of a washing process. That is, the deodorizing mode may be performed continuously after the washing process, or may be performed without the washing process.

For example, if the user presses both a washing button (not shown) and the deodorizing button 22, the deodorizing operation is performed after washing/rinsing/spin-drying/drying operations are performed. On the other hand, if the user presses only the deodorizing button 22, the deodorizing operation is performed without washing/rinsing/spin-drying/drying operations.

To perform the deodorizing mode, the microcomputer 20 transmits a control signal to the fan motor-driving unit 26 to blow air to the inside of the drum 3 for a first predetermined time, and simultaneously transmits a control signal to the drum motor-driving unit 24 to rotate the drum 3 (operation S42). Since the drum 3 is exposed to the blown air and rotated, the clothes put into the drum 3 are transformed, thereby causing particles of odor to be easily separated from the clothes impregnated with odor. The first predetermined time is set to a proper value by experiments.

The odor sensor 23 senses for ingredients of odor during the first predetermined time, and transmits the obtained result to the microcomputer 20. And after the first predetermined time has elapsed, the microcomputer 20 determines whether or not the odor sensor 23 senses ingredients of odor (operation S44).

If it is determined that the odor sensor 23 has sensed ingredients of odor, the microcomputer 20 opens the spraying valve 29 for a second predetermined time to humidify the drum 3 (operation S46). When water in the misty state is supplied to the drum 3, the water is bonded to the particles of the odor attached to the clothes. The second predetermined time is also set to a proper value by experiments.

After the water is supplied to the drum 3 for the second predetermined time, the microcomputer 20 transmits a control signal to the heater-driving unit 30 and the fan motor-driving unit 26 so as to turn on the heater 17 and the air blast fan 14, and supplies hot wind to the inside of the drum 3 for a third predetermined time (S48). The hot wind supplied to the drum 3 converts the water bonded to the particles of the odor to vapor, and the particles of the odor contained in the vapor are transmitted together with the hot blown air and are discharged to the outside of the drum type washing machine through an air outlet (not shown) formed at one side of the tub 2. Thereby, the particles of offensive odor, such as the smell of tobacco, food, etc., are removed from the clothes.

On the other hand, when the odor sensor 23 does not sense ingredients of odor in operation S44, the microcomputer 20 determines that offensive odor does not exist in the clothes and performs a post-treatment using a post-treatment device. According to one embodiment, the post-treatment device may include at least one of the humidifying device or an aroma supplying device having the anion-generating unit 31 and the aroma-generating unit 36, and supplies at least one of anions, a proper amount of water, or aroma to the object in the drum 3, such as clothes, to be deodorized. If anions are supplied to the object to be deodorized, the generation of static electricity in the object is reduced, and if water is supplied to the object to be deodorized, the object is softened.

Figure 3A:
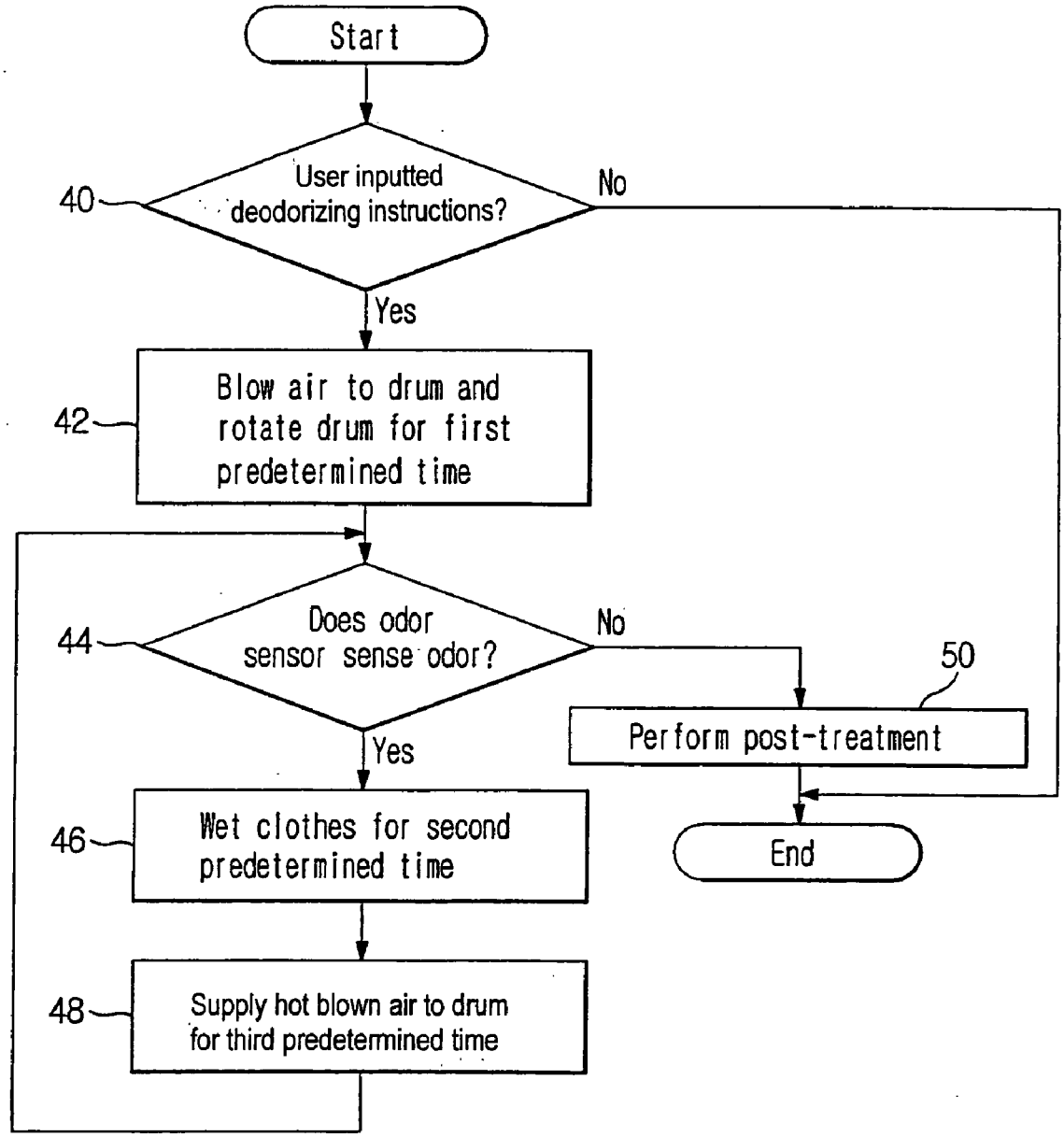
FIGS. 3*a* and 3*b* are flow charts illustrating a deodorizing operation of the drum type washing machine of FIG. 2B.
Figure 3B:
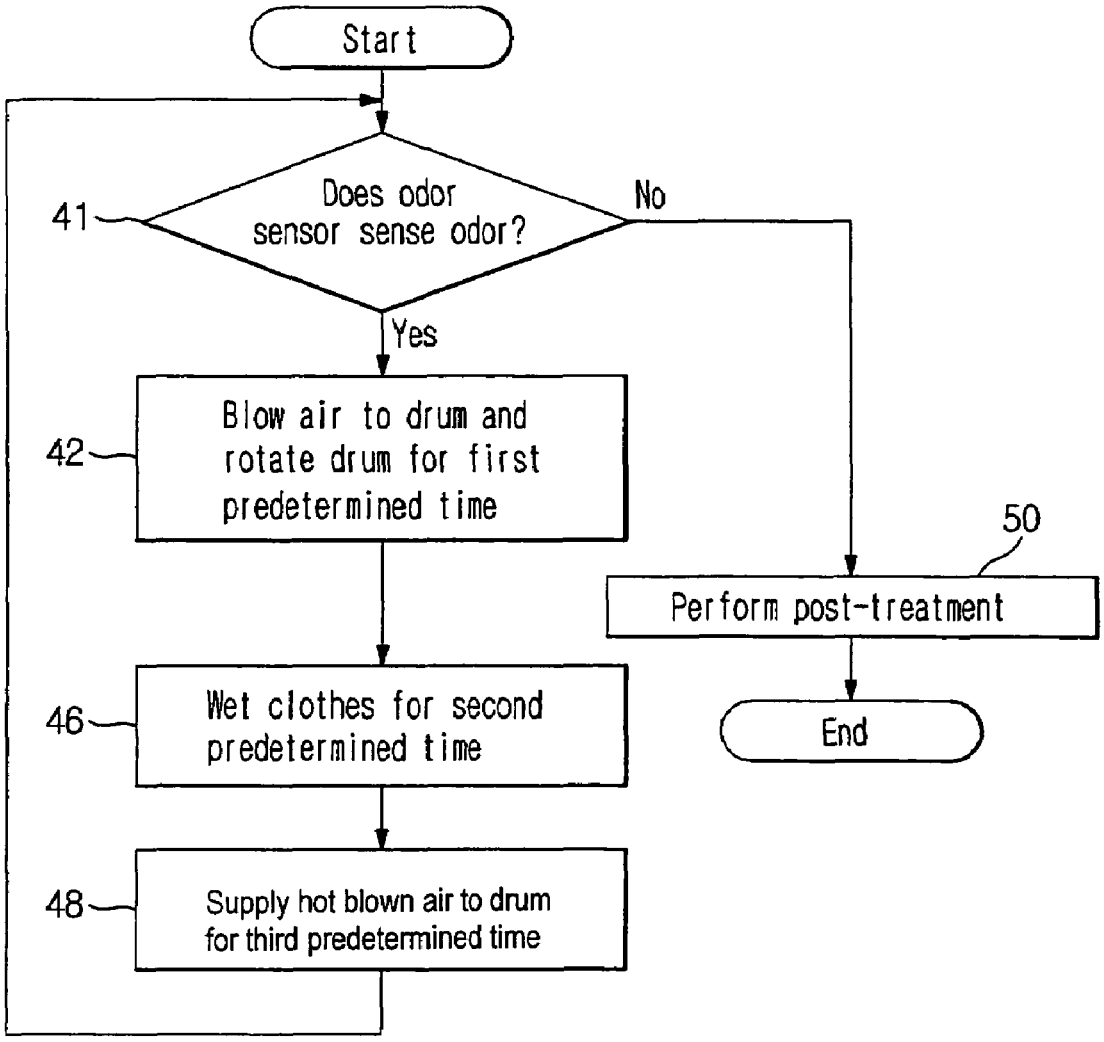

Operation S42 and operations S46 to S50 in FIG. 3*b*, which illustrates a deodorizing operation automatically performed when the odor sensor 23 senses odor, are the same as those in FIG. 3*a*, and their detailed descriptions will be omitted. In FIG. 3*b*, different from FIG. 3*a*, when the odor sensor 23 (odor sensing unit) senses odor regardless of whether the user inputs the deodorizing instructions to the washing machine, the microcomputer 20 performs the deodorizing mode (operation S41). Also, the deodorizing operation shown in FIG. 3*b* may be performed independently of the washing process. For example, if the odor sensor 23 senses odor in a state other than during a washing process, the microcomputer 20 performs the deodorizing mode without the user's deodorizing instructions.

Figure 4:
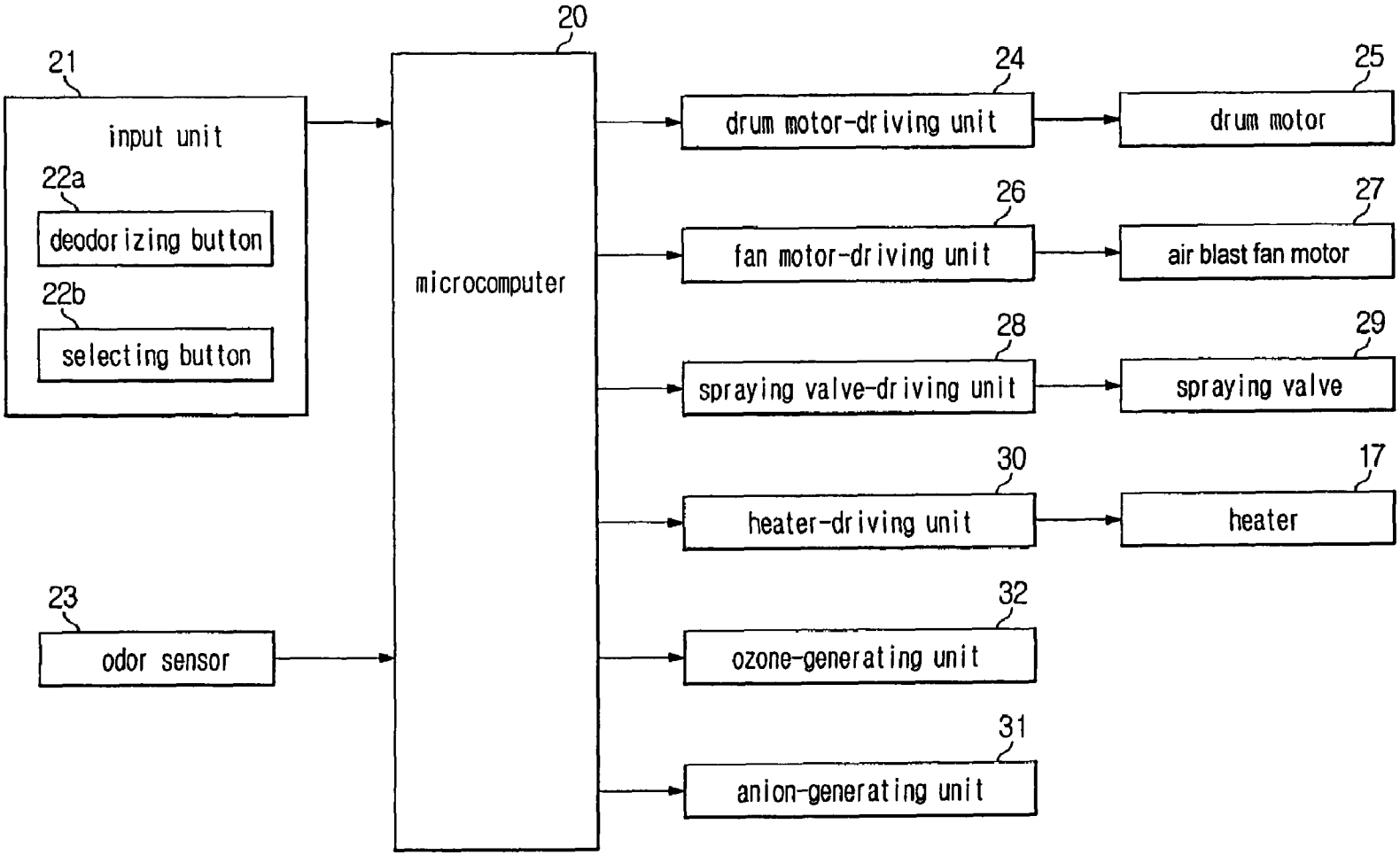
FIG. 4 is a block diagram of a drum type washing machine having a deodorizing unit in accordance with an embodiment of the present invention.

As shown in FIG. 4, a drum type washing machine in accordance with an embodiment of the present invention, in addition to the deodorizing unit shown in FIG. 2, further comprises an ozone-generating unit 32. The ozone-generating unit 32 generates ozone using silent discharge of electrolysis, and ozone purifies air, sterilizes water, and treats wastewater, as well as deodorizes objects.

Hereinafter, with reference to FIGS. 5*a* and 5*b*, an operation of the drum type washing machine shown in FIG. 4 will be described. Operations S60 to S64 in FIG. 5*a*, which illustrates a deodorizing operation performed by a user's deodorizing instructions, are the same as operations S40 to S44 in FIG. 3*a*, and operations S70 to S74 in FIG. 5*a* are the same as operations S46 to S50 in FIG. 3*a*, and thus their detailed descriptions will be omitted.

If the odor sensor 23 senses odor in operation S64, the microcomputer 20 controls the fan motor driving unit 26 to blow air to the drum 3 for a fourth predetermined time (operation S66). The fourth predetermined time is set to a proper value by experiments, and particles of odor are removed from the clothes by blowing the air, similar to operation S62.

Thereafter, the microcomputer 20 drives the ozone-generating unit 32 for a fifth predetermined time, to supply ozone to the inside of the drum 3 (operation S68). Ozone, which is supplied to the inside of the drum 3, decomposes the particles of odor, which are removed from the clothes or remain in the clothes, thereby deodorizing the clothes. The fifth predetermined time is also set to a proper value by experiments.

Figure 5A:
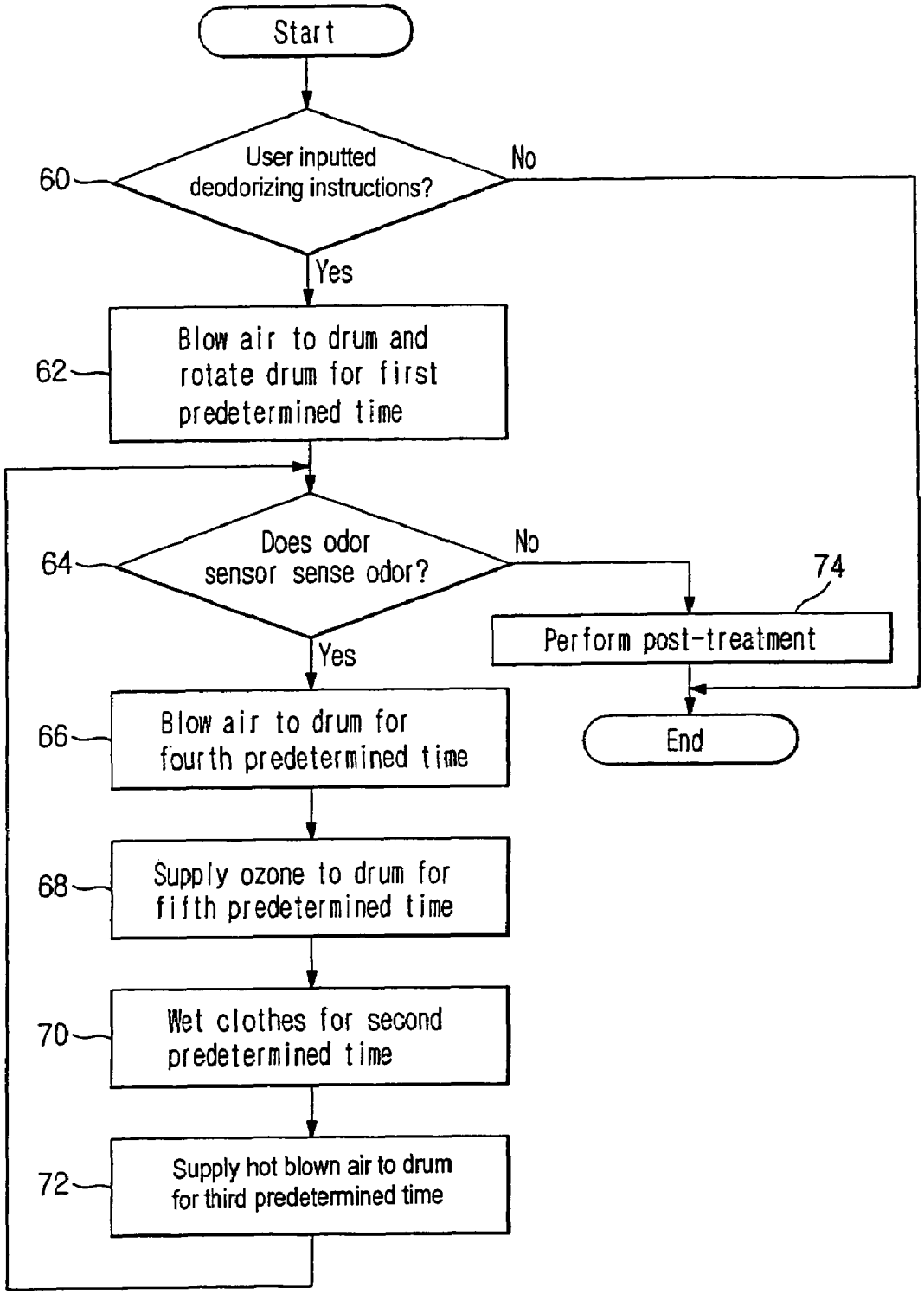
FIGS. 5*a* and 5*b* are flow charts illustrating a deodorizing operation of the drum type washing machine of FIG. 4.

In operations S70 and S72 in FIG. 5*a*, particles of offensive odor of ozone as well as the particles of odor remaining in the clothes are removed.

Although in this embodiment of the present invention, after operation S68 (supplying ozone to the inside of the drum 3 to deodorize the clothes put into the drum 3) operations S70 and S72 (wetting the clothes and supplying hot blown air to the inside of the drum 3) are additionally performed, according to one embodiment, only operation S68 is performed.

Figure 5B:
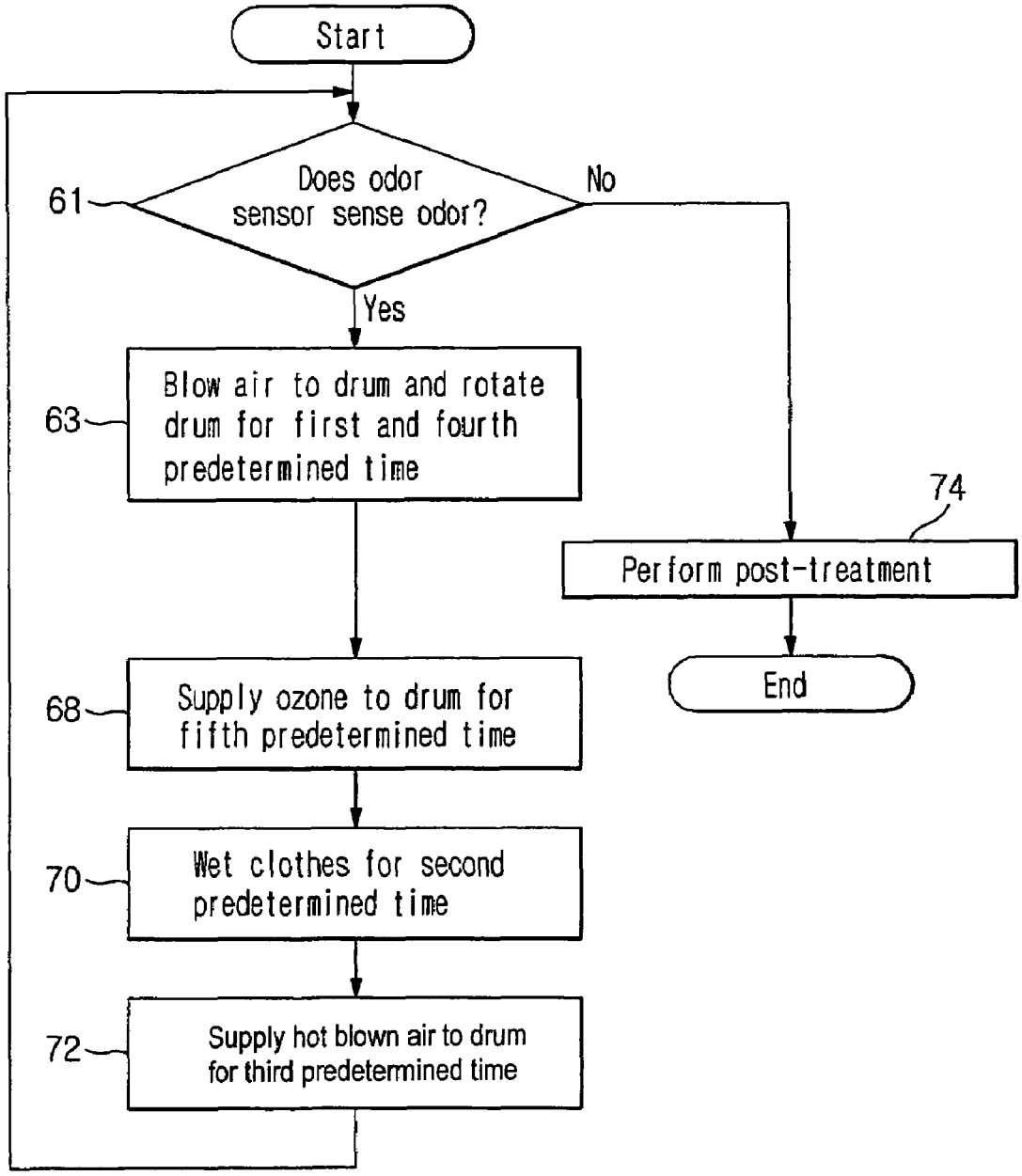

Operations S68 to S74 in FIG. 5*b*, which illustrates a deodorizing operation automatically performed when the odor sensor 23 senses odor, are the same as those in FIG. 5*a*, and their detailed descriptions will be omitted. In FIG. 5*b*, different from FIG. 5*a*, when the odor sensor 23 senses odor, regardless of whether the user inputs the deodorizing instructions to the washing machine, the microcomputer 20 performs the deodorizing mode (operation S61). Further, air is blown to the inside of the drum 3 for the first and fourth predetermined times prior to ozone being supplied to the inside of the drum 3 to deodorize the clothes put in the drum 3, thereby separating the particles of odor from the clothes to be deodorized (operation S63).

Figure 6:
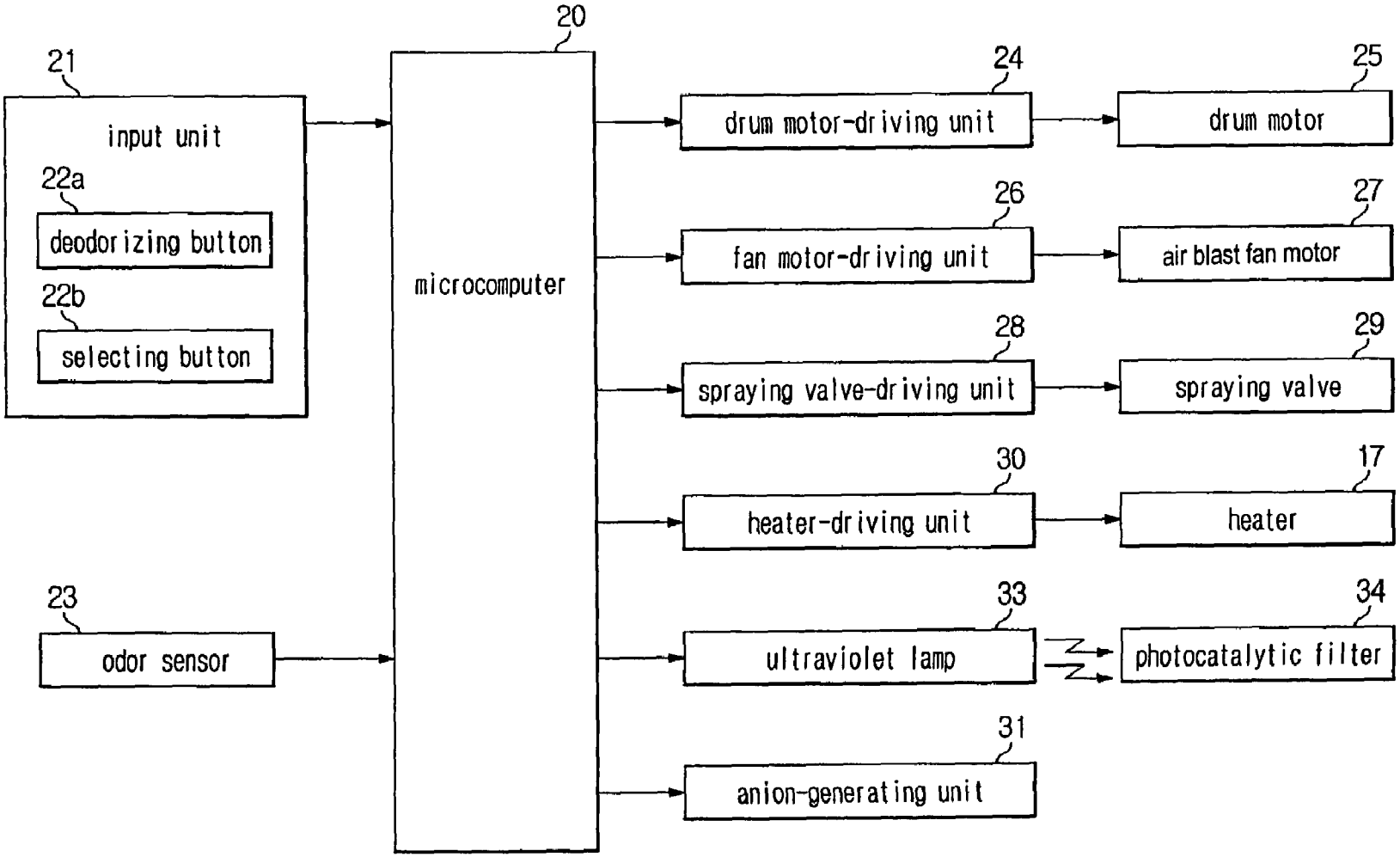
FIG. 6 is a block diagram of a drum type washing machine having a deodorizing unit in accordance with an embodiment of the present invention.

As shown in FIG. 6, a drum type washing machine in accordance with an embodiment of the present invention, in addition to the deodorizing unit shown in FIG. 2, further comprises an ultraviolet lamp 33, to activate a photocatalytic member (for example, $TiO_2$) of a photocatalytic filter 34.

Hereinafter, with reference to FIGS. 7*a* and 7*b*, an operation of the drum type washing machine shown in FIG. 6 will be described. Operations S80 to S84 in FIG. 7*a*, which illustrates a deodorizing operation performed by a user's deodorizing instructions, are the same as operations S40 to S44 in FIG. 3*a*, and operations S88 to S92 in FIG. 7*a* are the same as operations S46 to S50 in FIG. 3*a*, and thus their detailed descriptions will be omitted.

If the odor sensor 23 senses odor in operation S84, the microcomputer 20 turns on the ultraviolet lamp 33 for a sixth predetermined time (operation S86). When the ultraviolet lamp 33 is turned on, OH radicals are produced by photolysis using the photocatalytic member ($TiO_2$). OH radicals have high oxidation and reduction potentials, thus removing various offensive odors, such as NOx, SOx, volatile organic compounds (VOCs), and others. The sixth predetermined time is set to a proper value by experiments.

Although in this embodiment of the present invention, after the photolysis using the photocatalytic member ($TiO_2$), operations S88 and S90 (wetting the clothes and supplying hot blown air to the inside of the drum 3) are additionally performed, according to one embodiment, only the photolysis to deodorize the clothes is performed.

Figure 7A:
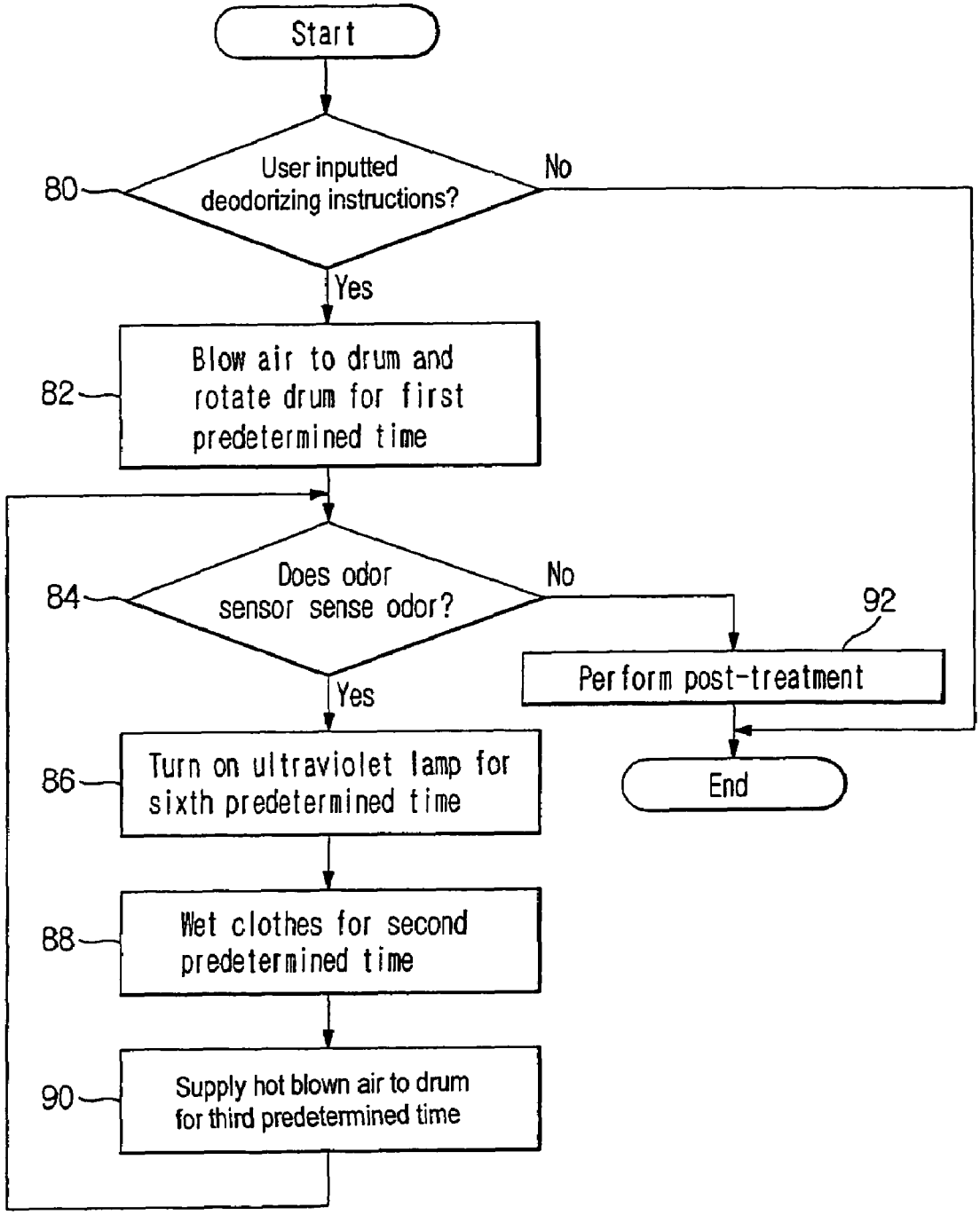
FIGS. 7*a* and 7*b* are flow charts illustrating a deodorizing operation of the drum type washing machine of FIG. 6.
Figure 7B:
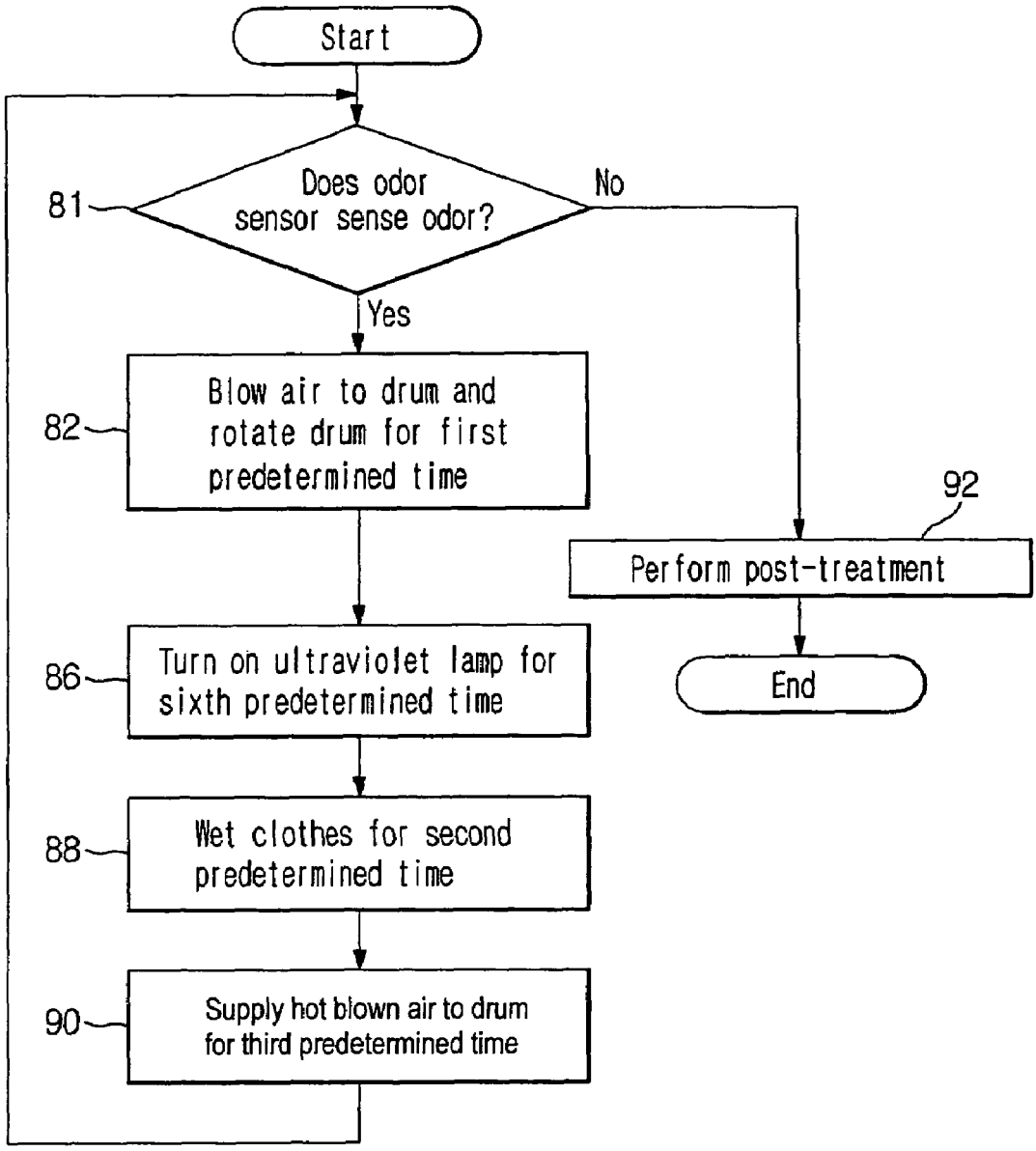

Operation S82 and operations S86 to 92 in FIG. 7*b*, which illustrates a deodorizing operation automatically performed when the odor sensor 23 senses odor, are the same as those in FIG. 7*a*, and their detailed descriptions will be omitted. In FIG. 7*b*, different from FIG. 7*a*, when the odor sensor 23 senses odor, regardless of whether the user inputs the deodorizing instructions to the washing machine, the microcomputer 20 performs the deodorizing mode (operation S81).

Figure 8:
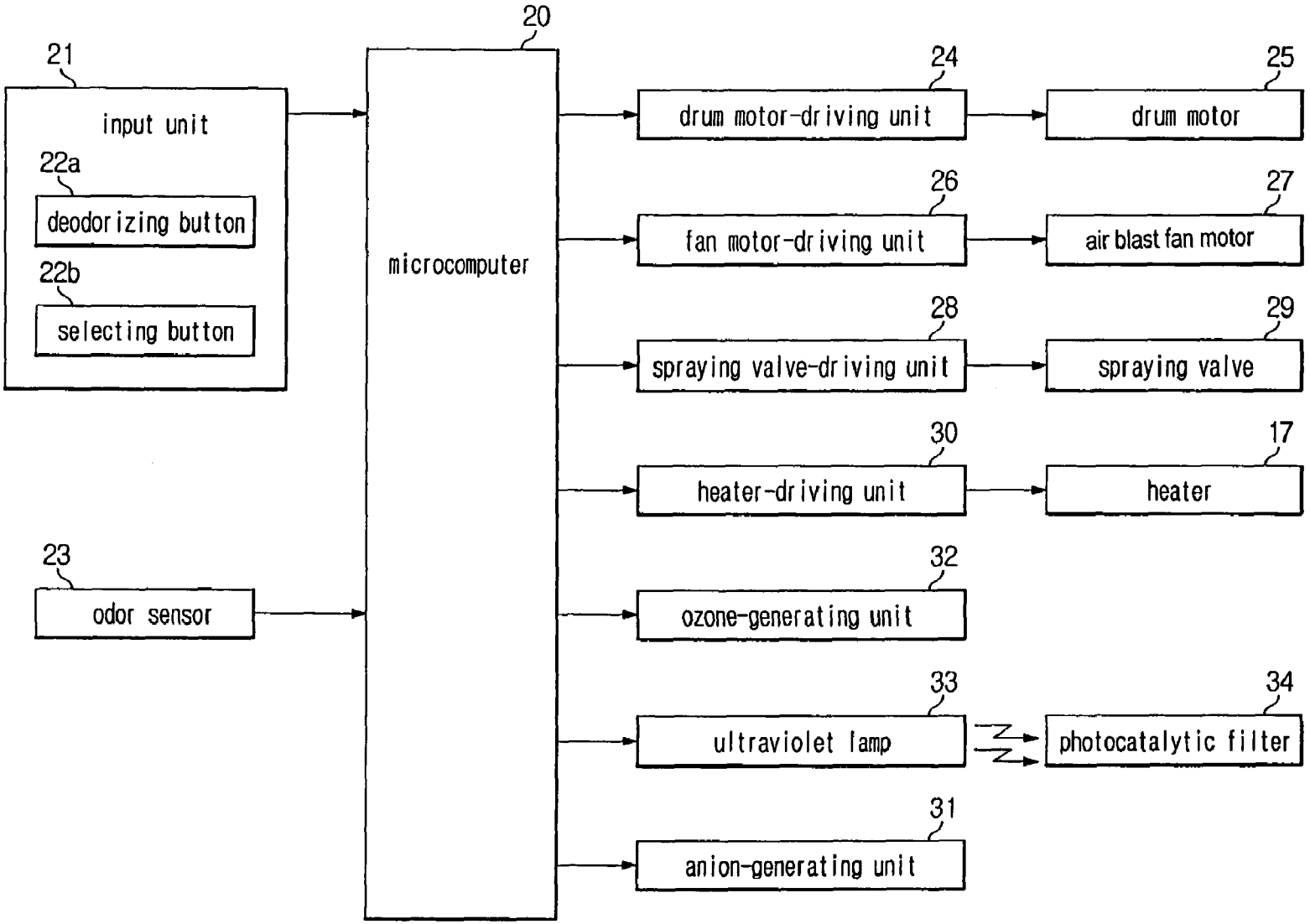
FIG. 8 is a block diagram of a drum type washing machine having a deodorizing unit in accordance with an embodiment of the present invention.

As shown in FIG. 8, a drum type washing machine in accordance with an embodiment of the present invention, in addition to the deodorizing unit shown in FIG. 2, further comprises the ozone-generating unit 32, the photocatalytic filter 34, and the ultraviolet lamp 33 as deodorizing resources.

Figure 9A:
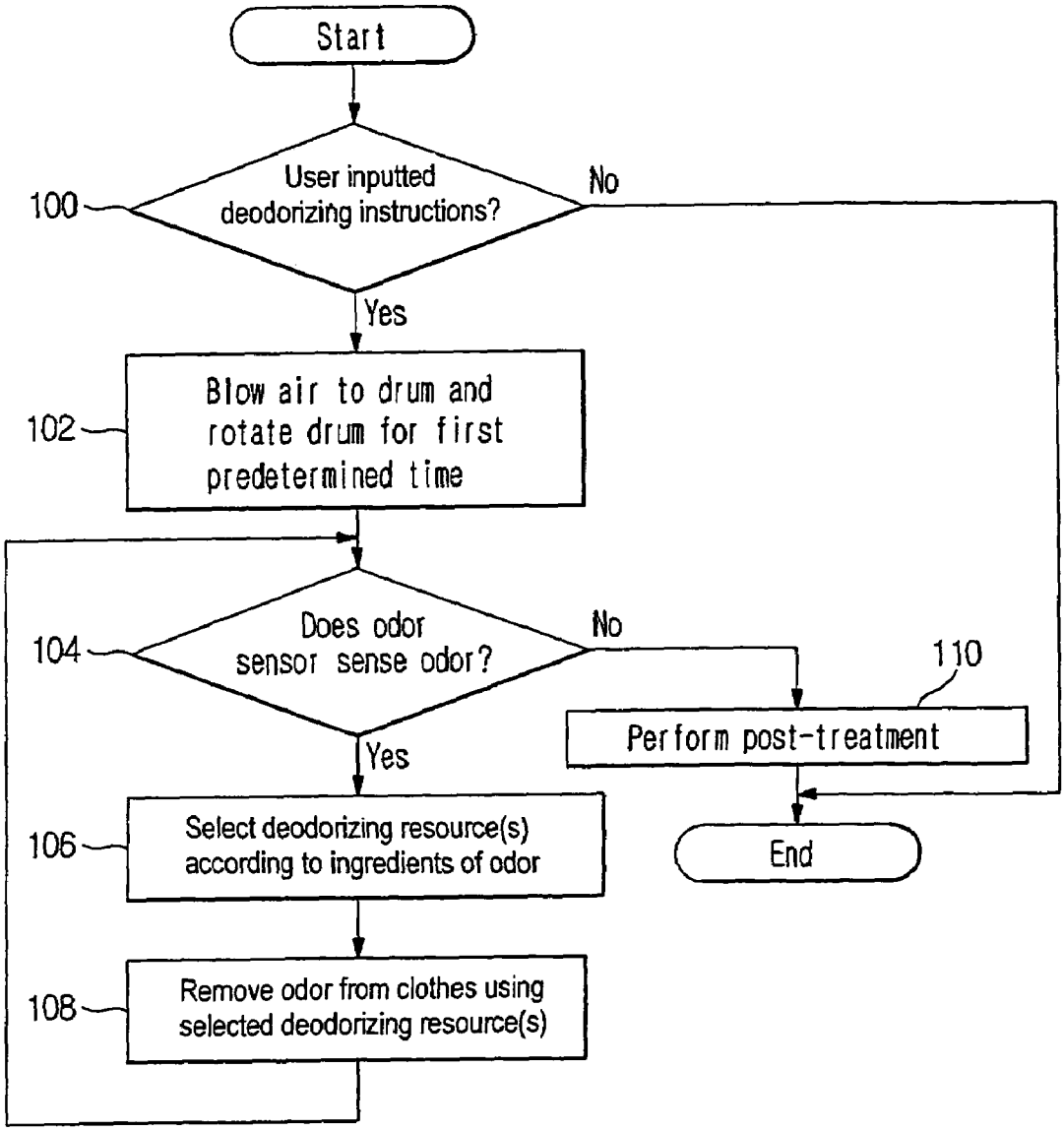
FIGS. 9*a* and 9*b* are flow charts illustrating a deodorizing operation of the drum type washing machine of FIG. 8.

Hereinafter, with reference to FIGS. 9*a* and 9*b*, an operation of the drum type washing machine shown in FIG. 8 will be described. Operations S100 to S104 in FIG. 9*a*, which illustrates a deodorizing operation performed by a user's deodorizing instructions, are the same as operations S40 to S44 in FIG. 3*a*, and operation S110 in FIG. 9*a* is the same as operation S50 in FIG. 3*a*, and thus their detailed descriptions will be omitted.

If the odor sensor 23 senses odor in operation S104, the microcomputer 20 analyzes a response signal of the odor sensor 23, thereby detecting ingredients of the odor. Thereafter, the microcomputer 20 selects a deodorizing resource based on the detected ingredients of the odor, and performs the deodorizing operation (operations S106 and S108). For example, if the microcomputer 20 determines that the ingredient of particles of the odor permeating the clothes put into the drum 3 is nitrate (NOx), the microcomputer 20 selects the photocatalytic filter 34 and the ultraviolet lamp 33 out of the various deodorizing resources shown in FIG. 8, and controls the deodorizing operation using the selected photocatalytic filter 34 and ultraviolet lamp 33.

If the microcomputer 20 determines that particles of the odor permeating the clothes put into the drum 3 is not a single ingredient, but rather comprises plural ingredients, the microcomputer 20 selects the plural deodorizing resources according to the plural ingredients. Accordingly, the microcomputer 20 stores data regarding the deodorizing resources having an excellent deodorizing effect according to the ingredients of odor, and uses the stored data when the microcomputer 20 selects the deodorizing resource or resources.

Although in this embodiment of the present invention, the microcomputer 20 selects the deodorizing resource(s) based on the odor sensed by the odor sensor 23, the deodorizing resource(s) may be selected by a manual manipulation when a user's deodorizing instructions are inputted to the washing machine, and the deodorizing operation may be operated by the selected deodorizing resource(s).

Figure 9B:
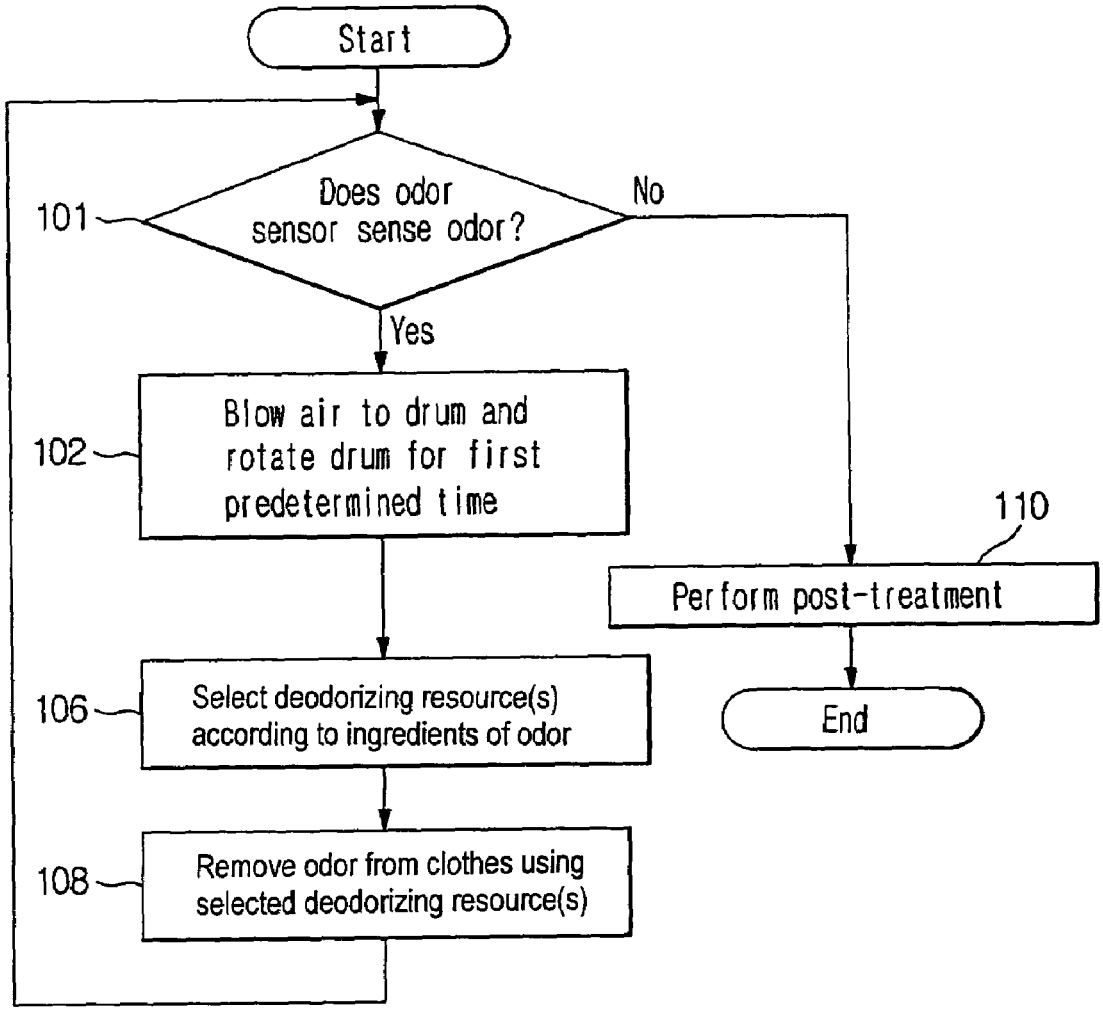

Operation S102 and operations S106 to 110 in FIG. 9*b*, which illustrates a deodorizing operation automatically performed when the odor sensor 23 senses odor, are the same as those in FIG. 9*a*, and their detailed descriptions will be omitted. In FIG. 9*b*, different from FIG. 9*a*, when the odor sensor 23 senses odor, regardless of whether the user inputs the deodorizing instructions to the washing machine, the microcomputer 20 performs the deodorizing mode (operation S101).

Although the above-described embodiments of the present invention perform separation of particles of odor from clothes in a deodorizing mode, sensing ingredients of the particles of odor by the odor sensor 23, and removing the particles of odor, according to one embodiment, only the operations of removing the particles of odor in the deodorizing mode is performed, without separating the particles of odor from the clothes or sensing ingredients of the particles of odor by the odor sensor 23.

It is possible to minimize wear-and-tear of the clothes and improve deodorizing efficiency by inputting a material (or a kind) of clothes to be deodorized through the selecting button 22*b*, and controlling the degree of operation of the deodorizing resources in the deodorizing mode according to the inputted material of the clothes to be deodorized. For example, if clothes to be deodorized are made of cotton and wool, since the cotton and wool have different heat resistances, the temperature of the supplied hot blown air and the quantity of the supplied water are properly adjusted, thereby protecting the materials of the clothes, such as cotton and wool, from the hot blown air.

Further, if some of the deodorizing resources are not proper to deodorize an object in FIG. 9*a*, after the material of the object to be deodorized is selected, the microcomputer 20 displays only usable deodorizing resources on a display unit (not shown) according to the selected material of the object, thereby allowing a user to select at least one deodorizing resource out of the displayed usable deodorizing resources.

According to one embodiment, a washing machine has a deodorizing resource; and a control unit to perform a deodorizing mode, using the deodorizing resource. The control unit may be, for example, the microcomputer 20.

According to one embodiment, the washing machine has: an input unit to input a deodorizing signal, an odor sensor, a selecting unit, and a post treatment device. The input unit may be, for example, the input unit 21. Similarly, the odor sensor may be the odor sensor 23, and the selecting unit may be the selecting unit 22*b*.

According to one embodiment, the post treatment device comprises anion-generating unit 31, the humidifying device, the aroma supplying device, and the hot blown air supplying device. Further, according to one embodiment, the deodorizing resource comprises the ozone-generating unit 32, the humidifying device, the hot blown air supplying device, the ultraviolet lamp 33, and the photocatalytic filter 34.

As is apparent from the above description, the present invention provides a washing machine having deodorizing resources deodorizing an object to be deodorized, and a control method thereof.

Further, with the washing machine of the present invention and the control method thereof, it is possible to simply and rapidly perform a deodorizing mode without performing a washing process.

Although embodiments of the invention have been shown and described, it would be appreciated by those skilled in the art that changes may be made in this embodiment without departing from the principles and spirit of the invention, the scope of which is defined in the claims and their equivalents.

What is claimed is:

1. A control method of a washing machine having a deodorizing unit comprising:

determining whether or not a deodorizing signal is inputted by a user; and performing a deodorizing mode using the deodorizing unit independently of a washing process, if it is determined that the deodorizing signal is inputted, wherein:

the performing of the deodorizing mode further includes selecting a kind of an object to be deodorized;

adjusting a degree of driving the deodorizing unit according to the selected kind of the object;

determining ingredients of odor of the object by an odor sensor;

selecting a deodorizing resource from a plurality of deodorizing resources according to the determined ingredients of odor; and performing a deodorizing operation by the selected deodorizing resource.

2. The control method according to claim 1, wherein the performing of the deodorizing mode includes:

separating particles of odor from the object to be deodorized by blowing air to the object;

deodorizing the separated particles of odor using the deodorizing unit; and discharging the deodorized particles of odor to an outside of the washing machine.

3. The control method according to claim 2, wherein the performing of the deodorizing mode further includes post-treating the object by supplying at least one of anions, water, or aroma to the object after the deodorizing of the separated particles of odor.

4. A control method of a washing machine having a plurality of deodorizing resources comprising:

determining whether or not a deodorizing signal is inputted by a user; and performing a deodorizing mode using at least one deodorizing resource selected from the plurality of deodorizing resources, if it is determined that the deodorizing signal is inputted, wherein:

the performing of the deodorizing mode further includes selecting a kind of an object to be deodorized;

adjusting a degree of driving the selected deodorizing resource according to the selected kind of the object;

determining ingredients of odor of the object by an odor sensor;

selecting a deodorizing resource from the plurality of deodorizing resources according to the determined ingredients of odor; and performing a deodorizing operation by the selected deodorizing resource.

5. The control method according to claim 4, wherein the performing of the deodorizing mode includes performing a deodorizing operation by the selected deodorizing resource.

6. The control method according to claim 5, wherein the performing of the deodorizing mode further includes post-treating the object by supplying at least one of anions, water, or aroma to the object after the deodorizing operation.

7. A control method of a washing machine having a plurality of deodorizing resources comprising:

determining whether or not a deodorizing signal is inputted by a user; and performing a deodorizing mode using at least one deodorizing resource selected from the plurality of deodorizing resources, if it is determined that the deodorizing signal is inputted, wherein:

the performing of the deodorizing mode further includes selecting a kind of an object to be deodorized;

limiting kinds of the deodorizing resources to be selected by the selected kind of the object;

determining ingredients of odor of the object by an odor sensor;

selecting a deodorizing resource from the plurality of deodorizing resources according to the determined ingredients of odor; and performing a deodorizing operation by the selected deodorizing resource.

8. The control method according to claim 7, wherein the performing of the deodorizing mode includes:

selecting at least one deodorizing resource from the plurality of deodorizing resources by the user;

separating particles of odor from the object by blowing air to the object; and performing a deodorizing operation using the selected deodorizing resource.

* * * * *

UNITED STATES PATENT AND TRADEMARK OFFICE

CERTIFICATE OF CORRECTION

PATENT NO. : 7,610,779 B2
APPLICATION NO. : 11/105400
DATED : November 3, 2009
INVENTOR(S) : Yang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1192 days.

Signed and Sealed this

Twelfth Day of October, 2010

David J. Kappos

David J. Kappos
*Director of the United States Patent and Trademark Office*